US006003727A

United States Patent [19]

Marshall

[11] Patent Number: 6,003,727

[45] Date of Patent: Dec. 21, 1999

[54] COIN OPERATED FRAGRANCE DISPENSING DEVICE

[76] Inventor: Bonnie R. Marshall, 251 Chippendale Cir., Apt. 413, Lexington, Ky. 40517

[21] Appl. No.: 09/159,347

[22] Filed: Sep. 23, 1998

[51] Int. Cl.[6] ..... B67D 5/10

[52] U.S. Cl. ..... 222/2; 222/132; 222/505

[58] Field of Search ..... 222/2, 132, 645, 222/646, 647, 648, 505

[56] References Cited

U.S. PATENT DOCUMENTS

| | | |
|---|---|---|
| 3,739,944 | 6/1973 | Rogerson . |
| 4,171,039 | 10/1979 | Ingham . |
| 4,358,860 | 11/1982 | Church . |
| 4,527,713 | 7/1985 | Ingram . |
| 4,625,342 | 12/1986 | Gangnath et al. . |
| 4,751,994 | 6/1988 | Brown, Jr. et al. . |
| 5,044,520 | 9/1991 | Moisan . |
| 5,126,078 | 6/1992 | Steiner et al. . |
| 5,595,324 | 1/1997 | Brown et al. . |
| 5,675,845 | 10/1997 | Martin et al. . |

*Primary Examiner*—Gregory L. Huson

*Attorney, Agent, or Firm*—Chase & Yakimo, L.C.

[57] ABSTRACT

A coin operated fragrance dispensing device comprises a casing having a plurality of actuation assemblies for dispensing a predetermined quantity of a user selected fragrance from a plurality of fragrance canisters therein. A lockable front door of the casing presents indicia and selection buttons corresponding to the fragrance canisters therein. The casing includes an adjustable holder adapted to carry variously sized fragrance canisters. A coin inserted through a slot in the front door of the casing falls upon a crank arm and is lodged between flanges thereon. The weight of the coin causes the arm to tilt and thus to pull down upon a pivot arm. As the shaft pivots about an axis established by a shaft which connects the pivot arms of each actuation assembly, push rods extend to move levers into open or unlocked positions. Accordingly, an actuation bar attached to a fragrance selection button is free to slidably engage a pressure responsive valve means of a fragrance canister. This engagement causes a predetermined quantity of the selected fragrance to be transmitted through a fluid line to a user pivotable nozzle. Alternatively, a separate coin slot with a crank arm can be utilized to initiate the dispensing of each fragrance.

20 Claims, 7 Drawing Sheets

Section
5-5

COIN OPERATED FRAGRANCE DISPENSING DEVICE

BACKGROUND OF THE INVENTION

The present invention relates generally to coin operated devices for dispensing fragrances and, more particularly, to a coin operated device which can spray a quantity of a user selected fragrance upon user actuation.

Odors common to individual stalls in public restrooms often linger for long periods of time, particularly where adequate ventilation is not available. Accordingly, an occupant of the stall may desire to have a more desirable fragrance sprayed within the stall to eliminate or at least mask the undesired lingering odor.

Various coin operated devices for dispensing fragrances are known in the prior art. Although assumably effective in operation, some devices require a power source for operation, such as electricity, batteries, or compressed air. Further, other devices in the prior art include expensive components such as air compressors.

Thus, it is desirable to have a coin operated fragrance dispenser which allows a user to select from a variety of fragrances. It is also desirable to have a fragrance dispenser which can dispense a fragrance upon a user inserting the proper coinage and pressing a button, without utilizing any additional power source.

SUMMARY OF THE INVENTION

In response thereto, I have invented a coin operated fragrance dispenser which utilizes a plurality of actuation assemblies mounted within a casing to dispense a predetermined quantity of a user selected fragrance from one of a plurality of fragrance canisters mounted therein. The casing includes a lockable front door having indicia and selection buttons thereon by which a user can select a fragrance to be dispensed. The casing further includes an adjustable assembly adapted to hold canisters of various sizes. The casing presents a coin slot wherein a user can deposit the proper coinage to initiate dispensing of a fragrance.

An inserted coin falls upon a crank arm and is lodged thereon. The weight of the proper coin causes the arm to tilt and thus to pull upon a shaft linked thereto by a pivot arm. As the shaft then rotates about its axis, at least one push rod simultaneously moves an associated lever/brake arm into an unlocked position. Accordingly, an actuation bar is freely user slidable to engage the pressure responsive valve of an associated fragrance canister upon a user depression of the selection button. This engagement causes a predetermined quantity of fragrance to be directed through a fluid line to a user pivotable nozzle.

Alternatively, the device includes an independent coin and actuation assembly for each canister having a different fragrance choice. Thus, the actuation assemblies need not be connected in order to dispense a desired fragrance.

It is therefore a general object of this invention to provide a fragrance dispenser which can dispense a predetermined quantity of a user-selected fragrance into the air.

Another object of this invention is to provide a fragrance dispenser, as aforesaid, which is coin actuated.

Still another object of this invention is to provide a fragrance dispenser, as aforesaid, having a casing which can hold a plurality of fragrance canisters.

Another object of this invention is to provide a fragrance dispenser, as aforesaid, which has a coin operated assembly for rotating a shaft in the housing, the shaft having a linkage assembly thereon which allows for user movement of a rod for activating a discharge of fragrance from the fragrance dispenser.

Yet another object of this invention is to provide a fragrance dispenser, as aforesaid, having a nozzle associated with each fragrance canister which can be directionally adjusted by a user.

A further object of this invention is to provide a fragrance dispenser, as aforesaid, which is adapted to be mounted to a restroom stall partition.

Still a further object of this invention is to provide a fragrance dispenser, as aforesaid, which is simple to construct and operate and requires no auxiliary power source.

Another particular object of this invention is to provide a fragrance dispenser, as aforesaid, which is adapted to hold and dispense fragrances from canisters of different sizes.

Other objects and advantages of this invention will become apparent from the following description taken in connection with the accompanying drawings, wherein is set forth by way of illustration and example, now preferred embodiments of this invention.

DESCRIPTION OF THE PREFERRED EMBODIMENT

Figure 1:
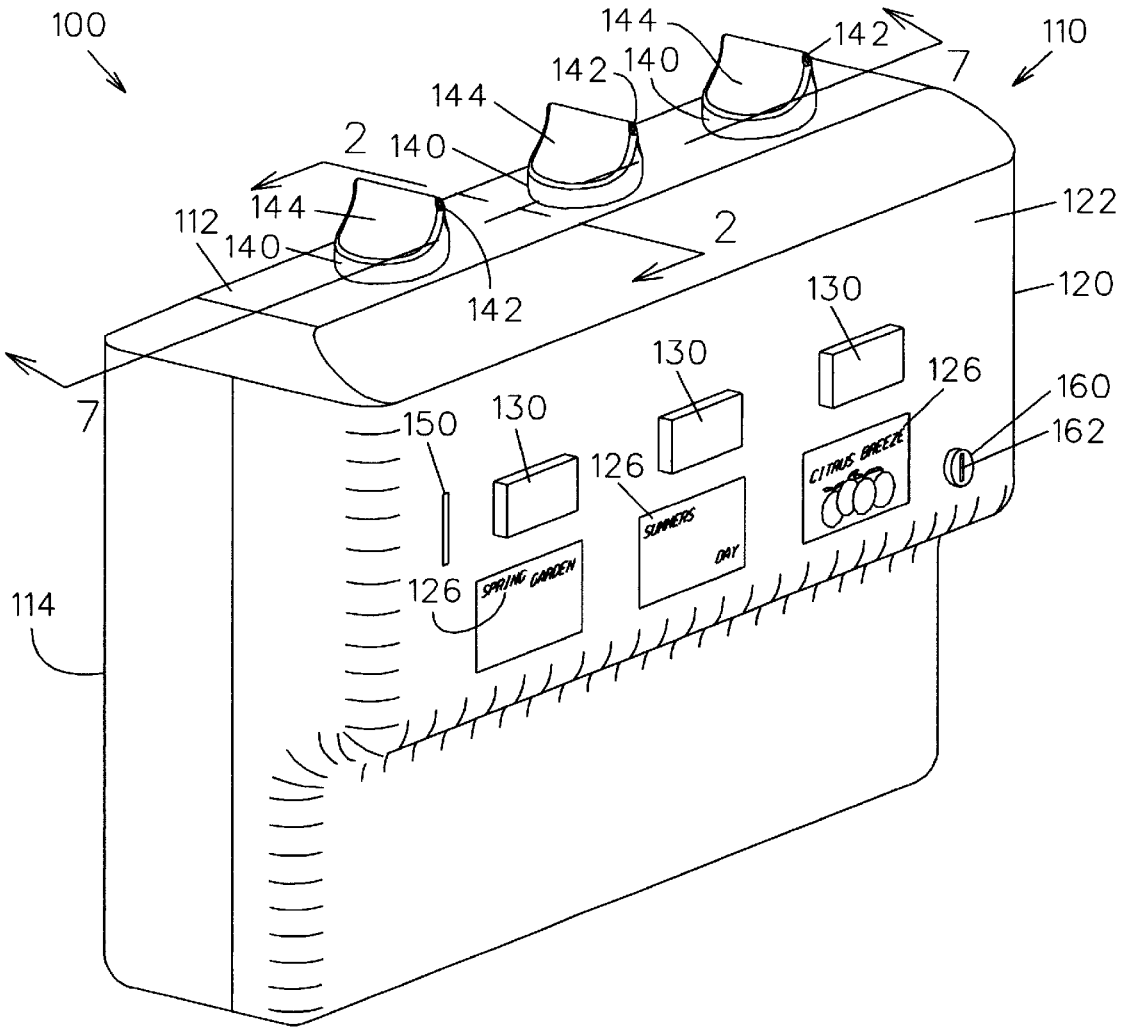
FIG. 1 is a perspective view of the fragrance dispenser.
Figure 7:
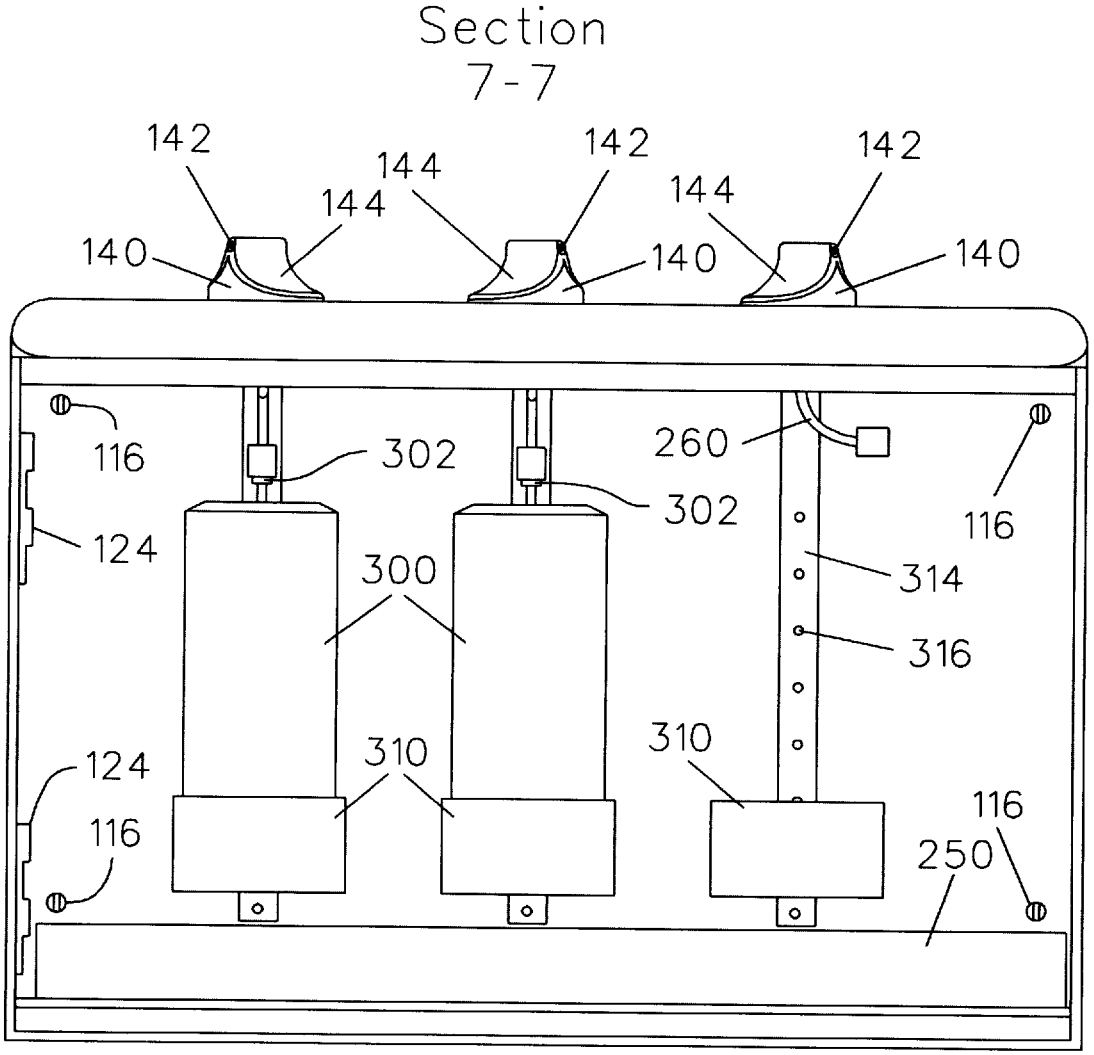
FIG. 7 is a sectional view of the fragrance dispenser taken along lines 7—7 of FIG. 1 showing the adjustable canister holding assembly.

Turning more particularly to the drawings, FIG. 1 shows the fragrance dispensing device 100 comprising a generally rigid casing 110 which interiorly carries components for dispensing a predetermined quantity of a user selected fragrance. The casing 110 is secured to a wall or toilet stall partition with fasteners 116 such as screws (FIG. 7). The casing 110 includes a front door 120 having indicia 126 on a front surface 122 thereof associated with each fragrance choice provided by the device 100. Selection buttons 130 associated with each fragrance choice extend through apertures in the front door 120 for actuating the dispensing of a fragrance as described below. Nozzle housings 140 associated with each fragrance choice are pivotally mounted to a top surface 112 of the casing 110, each housing having an outlet aperture 142 and symmetrically sloping sides 144 such that a user can easily grip the nozzle so as to adjust the direction of fragrance output. The front door 120 further includes a slot 150 for receiving coins therethrough.

A known lock system having a locking barrel 160 with a key slot 162 therein projects from the front surface 122 of the front door 120 and extends therethrough so as to lock the front door to the rear portion 114 of the casing 110 upon a turning of the barrel with a key. When the casing is unlocked, the front door swings open upon interiorly disposed hinges 124 to allow removal of coins, replacement of fragrance canisters, or for maintenance (FIG. 2).

Figure 2:
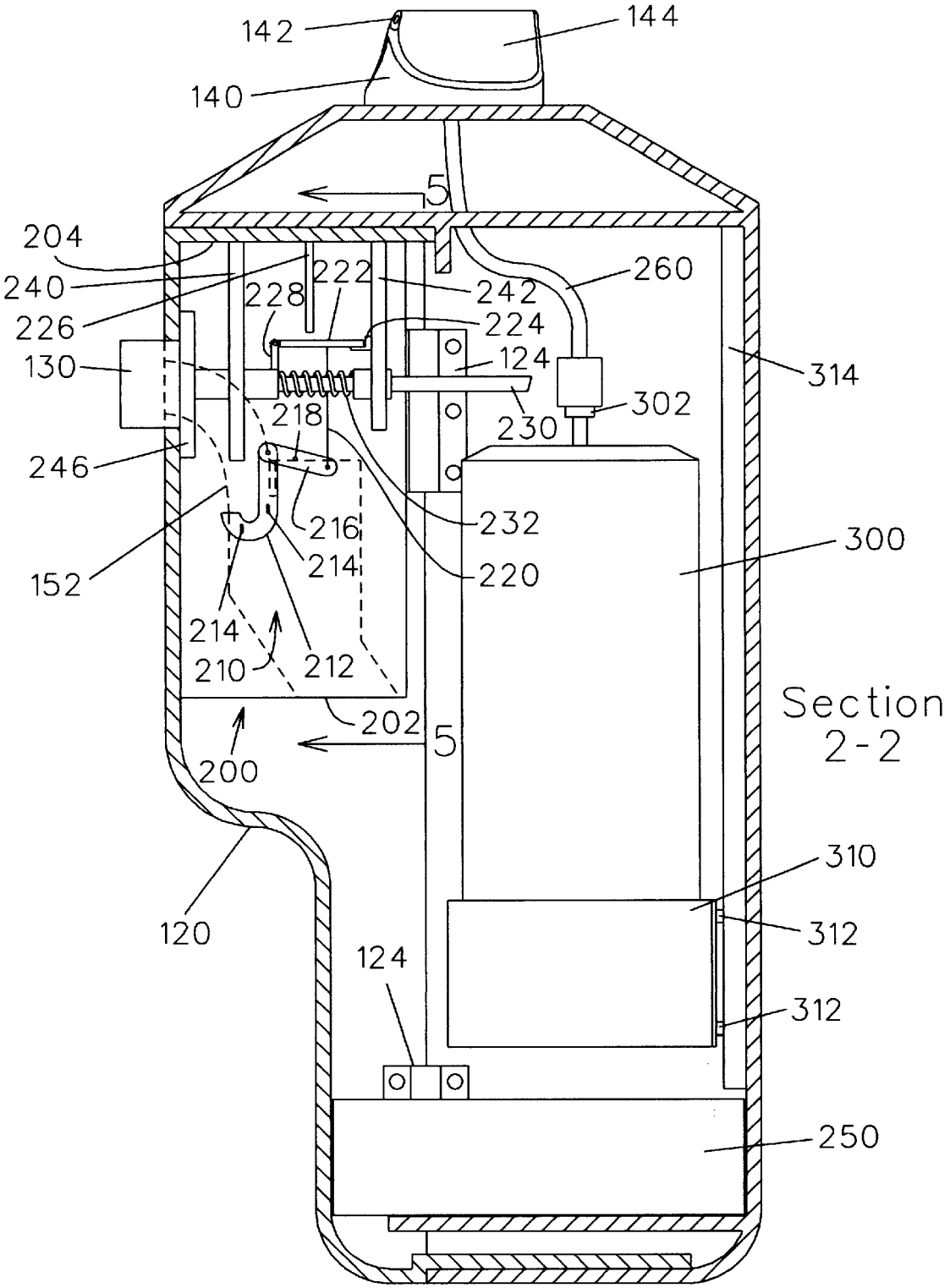
FIG. 2 is a sectional view of the fragrance dispenser taken along lines 2—2 of FIG. 1 with the actuation components in a first position.
Figure 5:
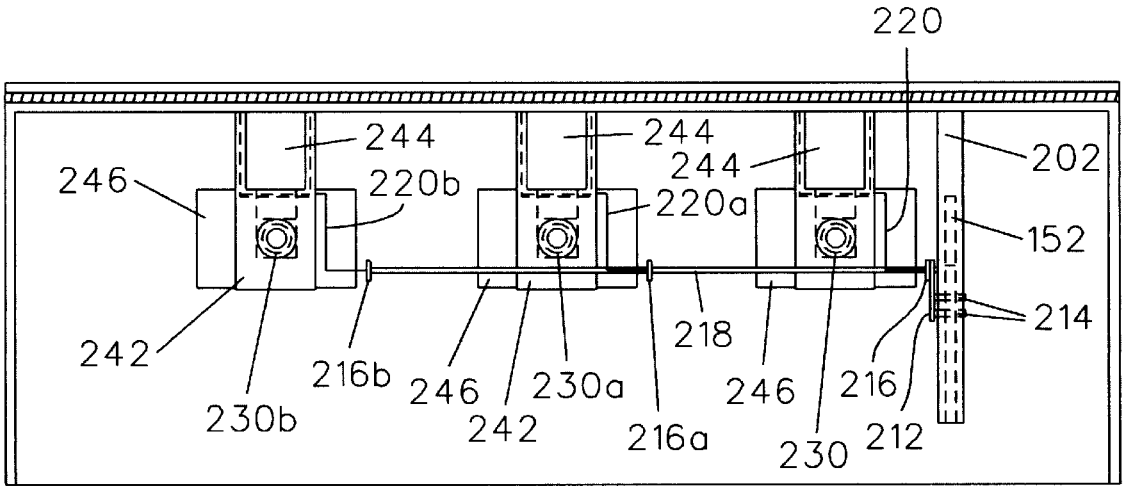
FIG. 5 is a sectional view of the fragrance dispenser taken along lines 5—5 of FIG. 2.

As shown in FIG. 2, a housing 200 having spaced apart side walls 202 with open back and bottom sides is fixedly attached to the rear surface of the front door 120 with an actuation assembly 210 mounted therein. The actuation assembly 210 comprises an upstanding J-shaped coin acceptor/crank arm 212 having a pair of spaced apart flanges 214 outwardly extending therefrom. The upper end of the crank arm 212 is fixedly attached to one end of a pivot arm 216. A connecting shaft 218 is fixedly attached to the center of the arm 216 and extends horizontally therefrom, the shaft being pivotally attached at an opposed end to a wall 202 of the housing 200 (FIGS. 2 and 5). Thus, the shaft 218 creates a pivot axis for the arm 216.

The lower end of an upstanding wire push rod 220 is pivotally attached to an opposed end of the arm 216 with the upper end of the rod being attached to a lever/brake arm 222. The lever 222 is pivotally attached to a post 228 which, in turn on an actuation bar 230. The actuation bar 230 is attached to the back side of a fragrance selector button 130. In a closed position, the lever 222 bears against a flange 224 so as to prevent horizontal movement of the actuation bar 230 in a left to right direction, as in FIG. 2.

The casing 110 further houses a plurality of aerosol fragrance canisters 300, each canister having a pressure responsive valve means presented by an actuation button 302 (FIG. 7). Each canister 300 is carried within a cup-like holder 310 having a pair of spaced apart pins 312 depending from a rear surface thereof. The pins 312 extend into selected apertures 316 along an adjustment bar 314. An adjustment bar 314 presents a plurality of spaced apart apertures 316 therethrough such that the height of the holder 310 can be regulated upon a user moving the holder to the desired height and then inserting the pins 312 into apertures 316. Thus, canisters of variable size can be used with the device 100.

Figure 3:
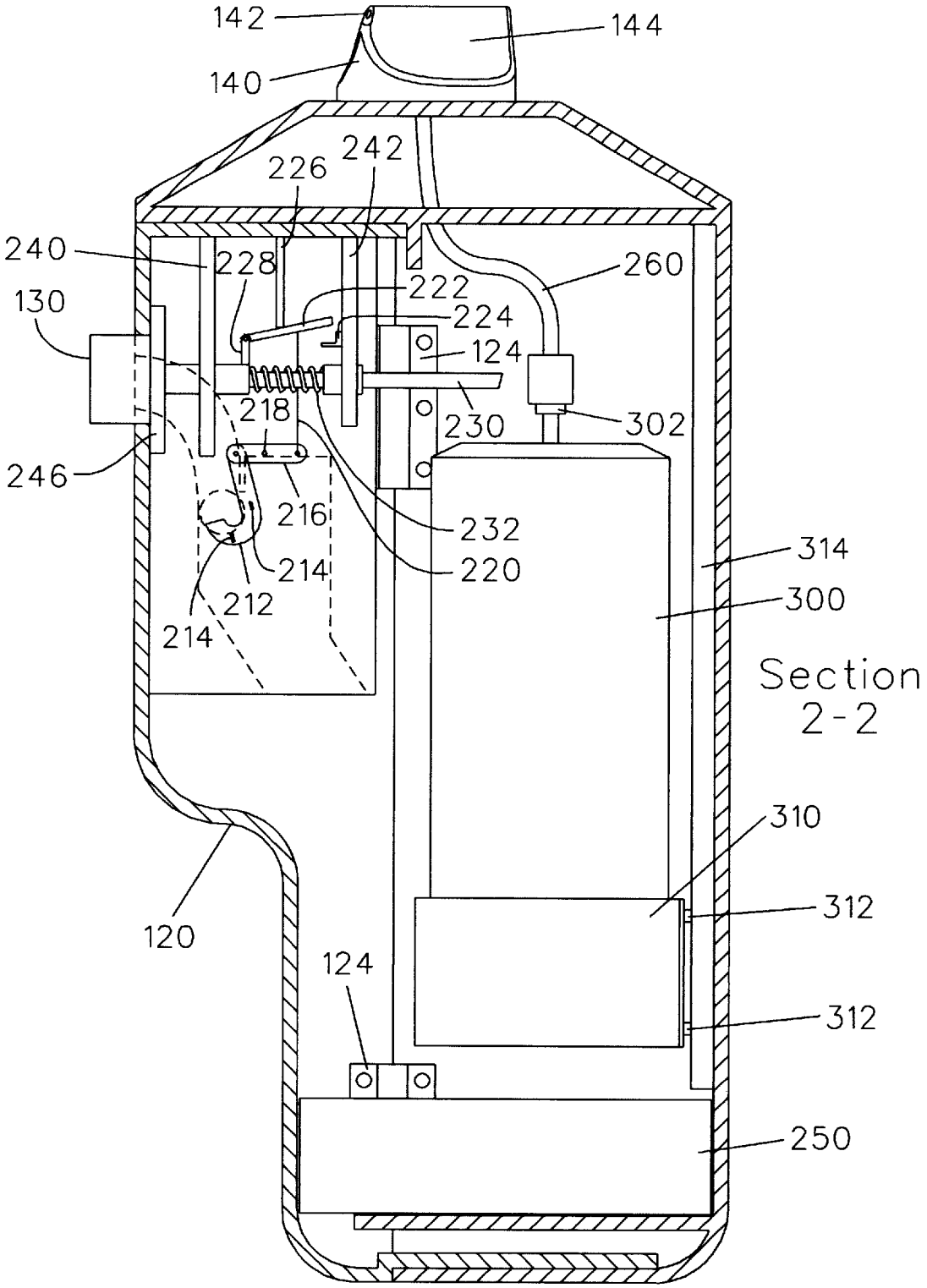
FIG. 3 is a view of the fragrance dispenser of FIG. 2 with the actuation components in a second position.

In operation, the crank arm 212 is shown in a first position prior to a coin being inserted into the device 100 with the brake arm 222 being in a position bearing against the depending partition 242, as in FIG. 2. When a coin is inserted through slot 150, the coin falls within a chute channel 152 and lodges on flanges 214 of crank arm 212. The weight of the coin causes the crank arm 212 to tilt and pull downward upon the end of the arm 216 to which the crank arm 212 is connected. As arm 216 then pivots shaft 218 rotates. Thus, rod 220 is upwardly urged to move lever 222 into a second position, as in FIG. 3. A downwardly extending bar 226 depends from a top surface 204 of the housing 200 and bears against the lever 222 in its open position so as to restruct pivotable movement of the lever/brake arm 222.

Figure 4:
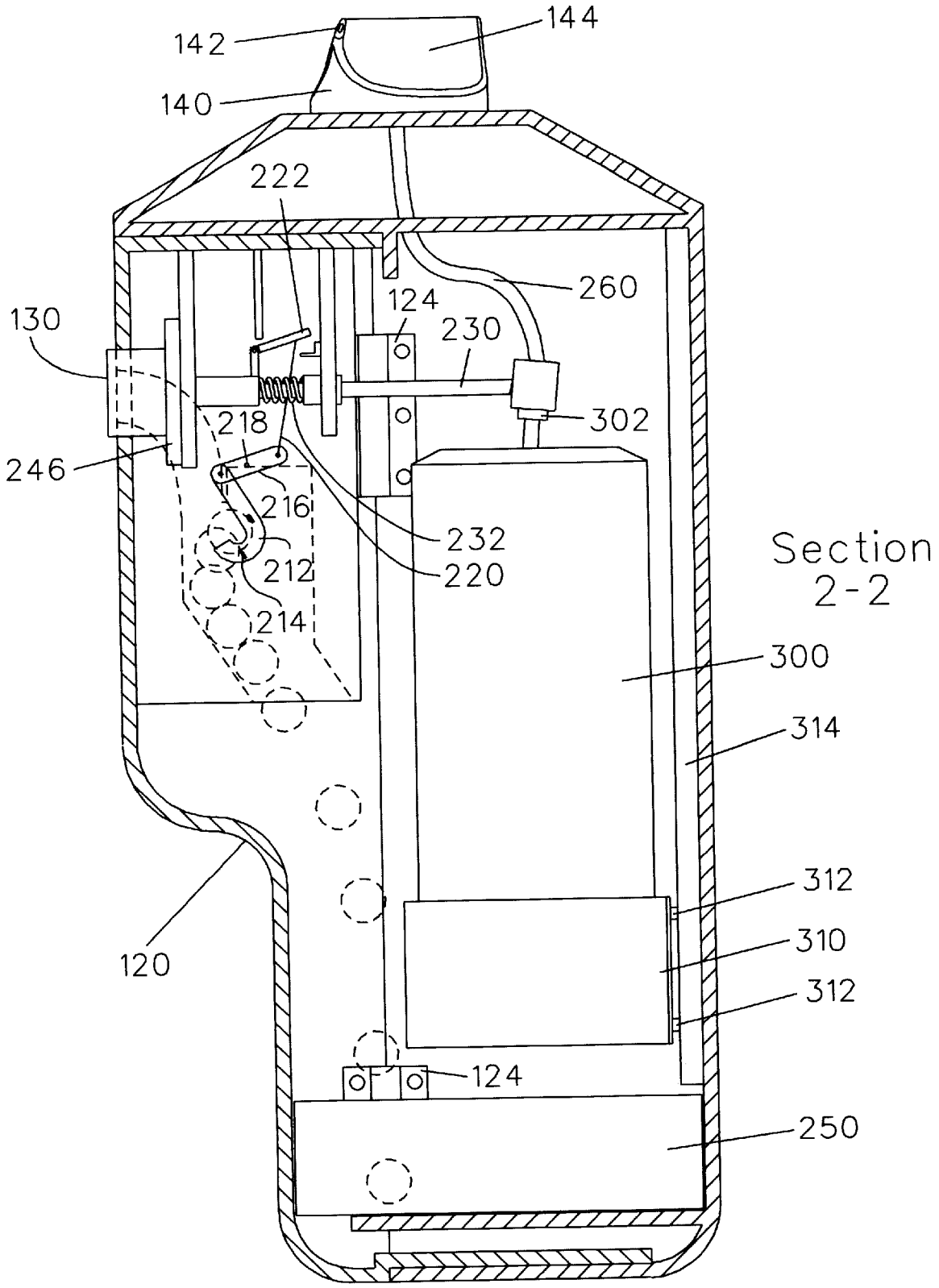
FIG. 4 is a view of the fragrance dispenser of FIG. 2 with the actuation components in a third position.

With lever 222 in an open position, an actuation bar/rod 230 is freely movable upon a user pressing a selection button 130. Upon full depression of a button 130, an actuation bar 230 is slidably moved through apertures in first 240 and second 242 support partitions and engages an actuating button 302, of a pressure responsive valve means on a fragrance canister 300, as in FIG. 4. A plate 246 fixedly attached to the button 130 bears against a first partition 240 upon full depression of a selector button 130 so as to prevent the actuation bar 230 from damaging the actuating button 302 on the canister 300. It is understood that as the actuation bar 230 moves into engagement with an actuating button 302 of a canister 300, the lever 222 in its open position extends through an aperture 244 in the second partition 242 to allow movement of the brake arm 222 through the aperture 244 and movement of rod 230 (FIG. 4).

Upon full extension of an actuation bar 230, the arm 216 is further pulled upwards causing the crank arm 212 to tilt such that the coin falls into a coin box 250 below. A spring bias 232 attached to the actuation bar 230 then causes the selector button 130 and bar 230 to return to their non-depressed position following a release of the user depression on button 130. Further, the lever 222 is returned to its closed position bearing against wall 242 to prevent the dispensing of a further quantity of fragrance until another coin is deposited. The return of arm 222 to its closed position urges push rod 220 to return to its FIG. 2 position which in turn moves arm 216 so as to rotate shaft 218 to its original FIG. 2 position. Thus, crank arm is moved to its FIG. 2 coin receptor position.

It is understood that actuation assemblies of identical construction and operation as that described above are provided for each of the plurality of fragrance canisters 300, as shown in FIGS. 5 and 7. It is further understood, however, that a single crank arm 212 initiates the operation of each assembly. As best shown in FIG. 5, the shaft 218 extends from a wall 202 of the housing 200 and is fixedly attached to arms 216, 216*a*, 216*b* of the actuation assemblies. Wire push rods 220, 220*a*, 220*b* are pivotally attached at one end to ends of each associated arm and are pivotally attached at opposed ends to associated levers 222 in the manner shown in FIG. 2. In function, as the arm 216 is pivoted as a result of the weight of a coin lodged upon the associated crank arm 212, the connecting shaft 218 is rotated. Accordingly, each downstream arm and associated rods 216*a*, 216*b* are simultaneously pivoted so as to cause the push rods 220, 220*a*, 220*b* to push each associated lever/brake arm into an open position. Actuation bars 230, 230*a*, 230*b* can then slidably engage actuation buttons 302 of the canisters 300 upon a user depression of a selector button 130 (FIGS. 4 and 7).

One end of a fluid line 260 is releasably attached to each canister actuation button 302 such that a predetermined quantity of fragrance is delivered therethrough when a button 302 is engaged by an actuation bar 230. As fluid lines are releasably attached to actuation buttons, empty canisters can be easily and quickly replaced (FIG. 7). An opposed end of each fluid line 260 is coupled to a nozzle housing 140, each housing being pivotally attached to the top surface 112 of the casing 110 so as to allow a user to adjust the direction of fragrance output through the outlet aperture 142.

Figure 6:
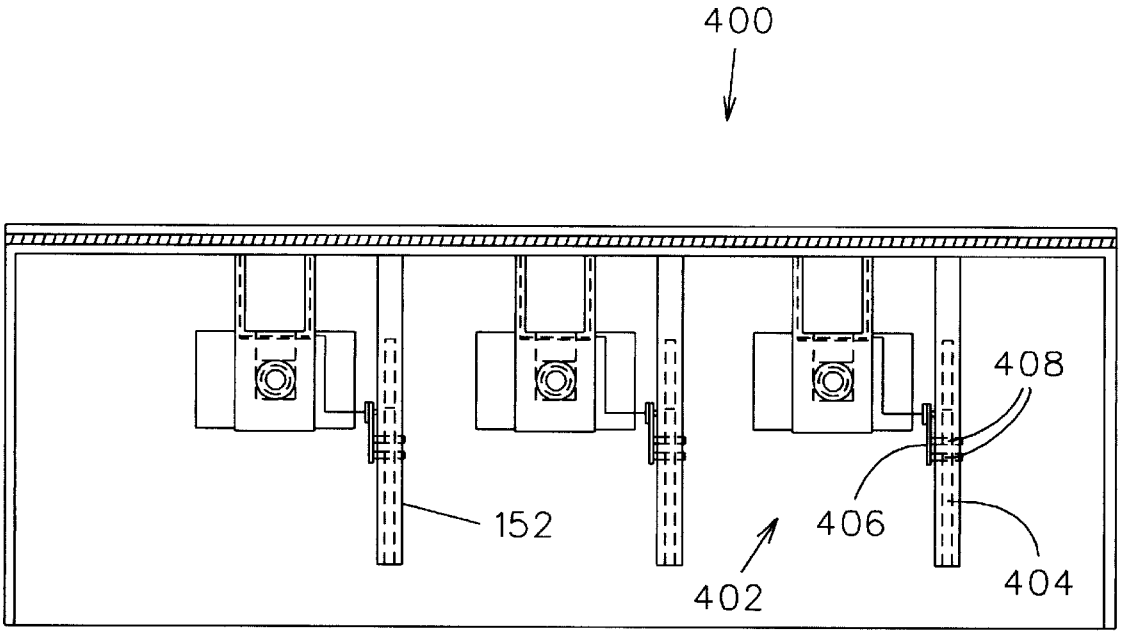
FIG. 6 is a sectional view of an alternative embodiment of the fragrance dispenser similar to FIG. 5 with a coin slot associated with each actuation assembly.

An alternative embodiment 400 of the device shown in FIG. 6 is very similar to the device 100 described above except as pointed out below. A separate and independent actuation assembly 402 is included for dispensing each user selected fragrance choice. More specifically, each assembly includes a separate coin channel 404 and crank arm 406 having outwardly extending flanges 408 for holding a coin thereon. Thus, no connecting rod is needed to dispense a quantity of a user selected fragrance.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A fragrance dispensation system comprising:

a housing having an exterior wall;

an interior partition in said housing;

a slot in said exterior wall of said housing adapted for a coin insertion therein;

a chute in said housing having a first end in communication with said slot and a second outlet end for discharge of a coin into the housing;

a rotatable shaft in said housing;

a pivot arm connected to said shaft, said arm having a first end and a second end;

a crank arm in said chute connected to said pivot arm first end, said crank arm movable between a first position upon reception of the coin passing through said chute and a second position for directing the coin to said chute second end;

a push rod connected to said arm second end and movable therewith between first and second positions, said push rod having a second end;

an actuator rod longitudinally movable in said housing, said rod having a first user operable end at said exterior wall and a second end extending through said partition;

a brake arm pivotally mounted to said actuator rod and having an end at a first position bearing against said partition to preclude movement of said actuator rod in a first direction, said second end of said push rod connected to said brake arm;

a canister having a pressure responsive valve means normally in a closed position, said canister adapted to store a fragrance therein, said actuator rod normally displaced from said valve means at said first position;

means for directing said fragrance from said valve means to an exterior of said housing, a deposit of a coin in said slot causing a movement of said crank arm at said first position towards said crank arm second position for directing the coin to said chute second end, said movement of said crank arm pivoting said arm for rotation of said shaft in a first direction, said shaft rotation urging said push rod to a second position to pivot said brake arm at said first position to a second brake arm position whereat said brake arm end is free of said partition, said second brake arm position allowing for a user movement of said actuator rod in said first direction to a second position bearing against said valve means for discharge of the fragrance from said canister and to said directing means.

2. The system as in claim 1, wherein said movement of said rod to said second position moves said crank arm to said second position for discharge of the coin into said housing.

3. The system as claimed in claim 2, further comprising means for biasing said actuator rod from said second position to said first position for displacing said actuator rod from said valve means, whereby to cease said discharge of the fragrance from said canister.

4. The system as claimed in claim 3, whereupon movement of said rod to said first position moves said brake arm to said first position whereat said brake arm urges said push rod to said first position for movement of said pivot arm and rotation of said shaft in an opposed second direction, whereby to return said brake arm, push rod and crank arm to said respective first positions.

5. The system as claimed in claim 1, further comprising:

an aperture in said partition for reception of said brake arm end therein at said second brake arm position, said aperture allowing for movement of said brake arm with said actuator rod to said rod second position.

6. The system as claimed in claim 5, further comprising bias means for urging said actuator rod to said first position away from said valve means and movement of said brake arm end from said aperture.

7. The system as claimed in claim 1, wherein said directing means comprises:

a conduit having a first end in communication with said valve means and a second end exterior of said housing.

8. The system as claimed in claim 7, further comprising a nozzle attached to said conduit second end.

9. The system as claimed in claim 1, further comprising:

a plurality of said pivot arms attached to said shaft;

a plurality of said push rods connected to said pivot arms in a one-to-one relationship with each said pivot arm;

a plurality of said actuator rods in a one-to-one relationship with each said pivot arm and push rod;

a plurality of said brake arms associated with each said actuator rod in a one-to-one relationship;

a plurality of said canisters with said valve means associated with each said actuator rod in a one-to-one relationship, whereby the coin on said crank arm rotates said shaft for movement of said pivot arms, push rods and associated brake arms to said second positions allowing for a user movement of at least one of said actuator rods to said second position allowing for discharge of the fragrance from said canister associated with said actuator rod at said second position.

10. The system as claimed in claim 9, further comprising:

a plurality of said slots associated with each said actuator rod in a one-to-one relationship therewith;

a plurality of said chutes associated with each said slot;

a plurality of said crank arms associated with each said chute in a one-to-one relationship therewith, each crank arm connected to a respective pivot arm, whereby a coin deposit in a respective chute provides said respective movement of said associated crank arm and associated pivot arm, push rod and brake arm to said second position to allow for said user movement of said associated actuator rod.

11. The system as claimed in claim 10, wherein a weight of the coin moves said associated crank arm to said second position for discharge of the coin from said associated crank arm into said housing.

12. The system as claimed in claim 11, further comprising means for biasing each said actuator rod to said first position for displacing said at least one actuator rod moved by the user from said associated valve means, whereby to cease said discharge of the fragrance from said canister.

13. The system as claimed in claim 12, further comprising:

a plurality of apertures in said partition in a one-to-one relationship with each brake arm for reception of said associated brake arm end therein at said second brake arm position, said apertures allowing for movement of said brake arms and said associated actuator rods to said respective second positions, whereby to allow said at least one actuator rod to be moved by the user against said associated valve means.

14. A fragrance dispensation system comprising:

a housing having an exterior wall;

an interior wall in said housing;

a slot in said exterior wall of said housing adapted for a coin insertion therein;

a chute having a first end in communication with said slot and a second outlet end for discharge of a coin into the housing;

a rotatable shaft in said housing;

means in said chute for rotating said shaft from a first position to a second position upon contact with a coin passing through said chute;

an actuator rod having a first end extending through said exterior wall and a second end extending through said interior wall;

a brake arm mounted to said actuator rod at a first position bearing against said interior wall to preclude movement of said actuator rod in a first direction;

means for linking rotation of said shaft to movement of said brake arm between said first position and a second position free of said interior wall;

a canister having a pressure responsive valve means normally in a closed position, said canister adapted to store a fragrance therein, said rod displaced from said valve means at a first position;

means for directing the fragrance from said valve means to an exterior of said housing upon a user movement of said rod to a second position against said valve means, a deposit of a coin in said slot contacting said rotating means to rotate said shaft to said second position, said linking means upon said shaft rotation to said second position moving said brake arm to said second position free of said interior wall to allow for a user movement of said actuator rod to said second position bearing against said valve means for discharge of the fragrance from said canister to said directing means.

15. The system as claimed in claim 14, wherein said rotating means comprises:

a pivot arm connected to said shaft, said arm having a first end and a second end; and a crank arm in said chute connected to said pivot arm first end, said crank arm movable between a first position for contact with the coin in said chute and a second position for directing the coin to said chute second end, said contact moving said crank arm and said pivot arm in a manner to rotate said shaft from said shaft first position to said shaft second position.

16. The system as claimed in claim 15, wherein said linking means comprises:

a push rod connected to said second end of said pivot arm;

said push rod presenting an end against said brake arm, said shaft at said second shaft position urging said push rod against said brake arm to move said brake arm to said second position free of said interior wall.

17. The system as claimed in claim 14, further comprising:

an aperture in said interior wall for reception of said brake arm therein at said second brake arm position, said aperture allowing for movement of said brake arm with said actuator rod to said second position.

18. The system as claimed in claim 14, further comprising means for biasing said actuator rod to said first position for displacing said actuator rod from said valve means, whereby to cease said discharge of fragrance from said canister.

19. A fragrance dispensation system comprising:

a housing having an exterior wall;

a slot in said exterior wall of said housing adapted for a coin insertion therein;

a chute in said housing having a first end connected to said slot and a second end for discharge of a coin into the housing;

an actuator rod having a first end adjacent said exterior wall and a second end in said housing, said rod movable between first and second positions;

brake means associated with said actuator rod having a first mode for allowing a user movement of said rod to said second position and a normal second mode for precluding user movement of said rod to said second position;

a canister having a pressure responsive valve means normally in a closed position, said canister adapted to store a fragrance therein, said rod displaced from said valve means at said first position and bearing against said valve means at said second position for discharge of the fragrance from said canister;

means for directing the discharged fragrance from said valve means to an exterior of said housing;

means for moving said brake means into said first mode upon a deposit of a coin in said slot for passage through said chute, said first mode allowing for a user operated movement of said rod to said second position, whereby to open said valve means for discharge of the fragrance from said canister to said directing means.

20. A system as claimed in claim 19 wherein said brake means comprises:

a flange in said housing, said brake means bearing against said flange in said second mode;

an aperture in said flange for receiving said brake means thereon at said first mode for movement of said brake means therethrough upon said user movement of said rod to said second position.

* * * * *